United States Patent [19]

Bohaski et al.

[11] Patent Number: 4,872,679

[45] Date of Patent: Oct. 10, 1989

[54] COMBINATION TABLE TOP FOOTBALL AND HOCKEY GAME

[76] Inventors: Frank L. Bohaski, 34 Penelope St.; Jack L. Horner, Jr., 244 Southern Ave., both of Pittsburg,, Pa. 15211

[21] Appl. No.: 280,575

[22] Filed: Dec. 6, 1988

[51] Int. Cl.[4] ..... A63F 7/06

[52] U.S. Cl. ..... 273/85 R; 273/94; 273/285; 273/128 R; 273/126 R

[58] Field of Search ..... 273/85 R, 285, 284, 273/247, 128 R, 94, 126 R, 148 R, 127 B, 1 ES; 434/169 I; 206/315.1; 116/222

[56] References Cited

U.S. PATENT DOCUMENTS

| | | | |
|---|---|---|---|
| 2,152,882 | 4/1939 | Engel | 273/94 |
| 2,801,853 | 8/1957 | Lombardo | 273/94 |
| 2,828,964 | 4/1958 | Horton | 273/94 |
| 3,554,549 | 1/1971 | Grabewski | 273/94 |
| 4,550,911 | 11/1985 | Daley | 273/94 |
| 4,555,114 | 11/1985 | Dozier | 273/126 R |
| 4,733,867 | 3/1988 | Kemp et al. | 273/85 R |
| 4,765,622 | 8/1988 | Rienzo | 273/85 R |

FOREIGN PATENT DOCUMENTS

| | | | |
|---|---|---|---|
| 1529040 | 10/1978 | United Kingdom | 273/126 R |

*Primary Examiner*—Edward M. Coven
*Assistant Examiner*—S. Passaniti
*Attorney, Agent, or Firm*—Jerry T. Kearns

[57] ABSTRACT

A combination table top football and hockey game utilizes a rectangular board formed by two rectangular sections connected along a central line by a hinge for movement between open and closed positions. The board has front and back surfaces designated respectively as a football field game area and a hockey rink game area. By inverting the game board, either table top football or table top hockey may be played. A scoreboard is removably received in an invertible fashion in mounting brackets provided on a side wall of the board, for use with either the football game area or the hockey game area. Two pairs of spaced aligned notches are formed in interior portions on opposed side walls of the game board for removable insertion of a pair of elongated rectangular slats. The slats are disposed in a common plane upon movement of the game board to a closed position and form a retaining wall of the closed case. The invention provides a standardized format and rules for two games which have been played in casual fashion utilizing improvised pieces, by school children for many years.

18 Claims, 5 Drawing Sheets

COMBINATION TABLE TOP FOOTBALL AND HOCKEY GAME

BACKGROUND OF THE INVENTION

1. Field of the Invention

The present invention relates to table top football and hockey games, and more particularly pertains to a combination game board and storage case which is invertible to provide both a football field game area and a hockey rink game area. School children have played improvised forms of table top football and table top hockey for many generations, utilizing football game pieces formed from folded paper, and hockey game pieces formed by coins of various different denominations. The rules and formats of these games have generally been improvised during play and no standard rules or standard game board or playing piece format has been established. In order to provide a standardized version of these games to enable competition by individuals from different schools and geographic areas, the present invention provides a specifically dimensioned game board and specifically sized football and hockey playing pieces along with a standard set of game rules.

2. Description of the Prior Art

Various types of table top football and hockey games are known in the prior art. A typical example of such a table top football and hockey game is to be found in U.S. Pat. No. 2,152,882, which issued to L. Engel on Apr. 4, 1939. This patent discloses a flat rectangular playing board having a pair of hinged goals attached at opposite ends. U.S. Pat. No. 2,801,853, which issued to J. Lombardo et al on Aug. 6, 1957, discloses a football game which utilizes a flat rectangular game board bearing indicia representing yard markers and having a pair of goal posts at opposite ends. U.S. Pat. No. 2,828,964, which issued to M. Horton on Apr. 1, 1958, discloses a flat rectangular game board simulating a football field which utilizes a plurality of spool shaped playing pieces to simulate football players. U.S. Pat. No. 3,554,549, which issued to T. Grabowski on Jan. 12, 1971, discloses a game which utilizes a flat rectangular game board having goal areas designated at opposite ends thereof. A magnetic game piece and a magnetic stick are utilized to impel pieces across the game board. U.S. Pat. No. 4,550,911, which issued to J. Daley on Nov. 5, 1985, discloses a football simulation game which includes a playing board having indicia representing yardage makers. A football shaped game piece is manually flicked through the air to strike a grid area secured to a goal post.

While the above mentioned devices are suited for their intended usage, none of these devices discloses a combination table top football and hockey game which utilizes a rectangular game board formed by two hinged sections bearing indicia representing a football field game area and a hockey rink game area on opposite faces thereof. Additionally, none of the above described game devices discloses the use of a specially constructed invertible case which provides two distinct playing areas and also forms a storage case for playing pieces and accessories. Additional features of the present invention, not disclosed by the prior art devices includes the provision of an invertible scoreboard having electronic digital display time and score indicators and powered by a solar cell. Inasmuch as the art is relatively crowded with respect to these various types of table top football and hockey games, it can be appreciated that there is a continuing need for and interest in improvements to such table top football and hockey games, and in this respect, the present invention addresses this need and interest.

SUMMARY OF THE INVENTION

In view of the foregoing disadvantages inherent in the known types of table top football and hockey games now present in the prior art, the present invention provides an improved combination table top football and hockey game. As such, the general purpose of the present invention, which will be described subsequently in greater detail, is to provide a new and improved combination table top football and hockey game which has all the advantages of the prior art table top football and hockey games and none of the disadvantages.

To attain this, a representative embodiment of the concepts of the present invention is illustrated in the drawings and makes use of a rectangular board formed by two rectangular sections connected along a central line by a hinge for movement between open and closed positions. The board has front and back surfaces designated respectively as a football field game area and a hockey rink game area. By inverting the game board, either table top football or table top hockey may be played. A scoreboard is removably received in an invertible fashion in mounting brackets provided on a side wall of the board, for use with either the football game area or the hockey game area. Two pairs of spaced aligned notches are formed in interior portions on opposed side walls of the game board for removable insertion of a pair of elongated rectangular slats. The slats are disposed in a common plane upon movement of the game board to a closed position and form a retaining wall of the closed case. The invention provides a standardized format and rules for two games which have been played in casual fashion utilizing improvised pieces, by school children for many years.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved combination table top football and hockey game which has all the advantages of the prior art table top football and hockey games and none of the disadvantages.

It is another object of the present invention to provide a new and improved combination table top football and hockey game which may be easily and efficiently manufactured and marketed.

It is a further object of the present invention to provide a new and improved combination table top football and hockey game which is of a durable and reliable construction.

An even further object of the present invention is to provide a new and improved combination table top football and hockey game which is susceptible of a low cost of manufacture with regard to both materials and labor, and which accordingly is then susceptible of low prices of sale to the consuming public, thereby making such table top football and hockey games economically available to the buying public.

Still yet another object of the present invention is to provide a new and improved combination table top football and hockey game which provides in the apparatuses and methods of the prior art some of the advantages thereof, while simultaneously overcoming some of the disadvantages normally associated therewith.

Still another object of the present invention is to provide a new and improved combination table top football and hockey game which provides a standardized format which enables widespread competition in two popular types of games which have previously been casually played with no standard rules or format.

Yet another object of the present invention is to provide a new and improved combination table top football and hockey game which utilizes a hinged invertible game board which forms a carrying case and two distinct game playing areas.

Even still another object of the present invention is to provide a new and improved combination table top football and hockey game which utilizes an invertibly secured scoreboard for use with game playing areas on opposite sides of a game board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
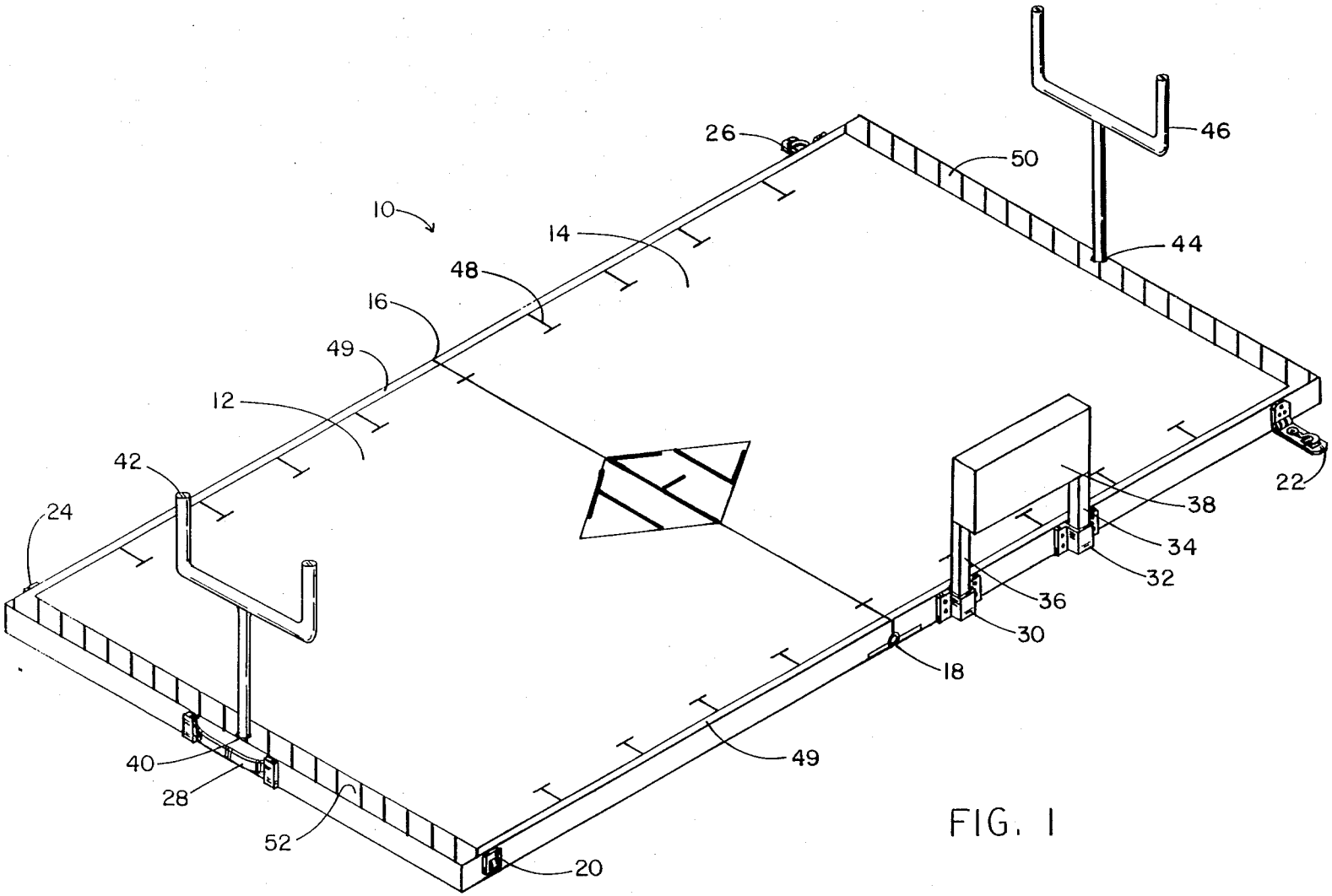
FIG. 1 is a perspective view of the front surface of the game board of the present invention, illustrating the board in an open position for use in playing table top football.

With reference now to the drawings, and in particular to FIG. 1 thereof, a new and improved combination table top football and hockey game embodying the principles and concepts of the present invention and generally designated by the reference numeral 10 will be described.

More specifically, it will be noted that the first embodiment 10 of the invention includes a rectangular board formed by two rectangular sections 12 and 14 connected along a central line 16 by a hinge 18. The joint 16 is preferably formed as a tongue and groove joint or a ship-lap joint so as to provide no interruption in the playing surface. The illustrated football field game area formed on the front surface of the game board bears indicia 48 representing yardage markers, indicia 49 representing side lines and indicia 50 and 52 designating opposed end zones. A pair of sockets 40 and 44 are provided in opposite end zones 52 and 50 for the removable reception of goal posts 42 and 46. A first pair of cooperating aligned latches 20 and 24 are provided on opposite side walls of the game board for cooperation with a second pair of aligned latches 22 and 26, for securing the game board in a closed position. A carrying handle is provided on each end wall of the game board. One of the handles 28 is illustrated in FIG. 1. A pair of spaced aligned scoreboard mounting brackets 30 and 32 are secured on a side wall of the rectangular board. A scoreboard 38 has a pair of aligned spaced legs 34 and 36 which are removably received in the mounting brackets 30 and 32.

Figure 2:
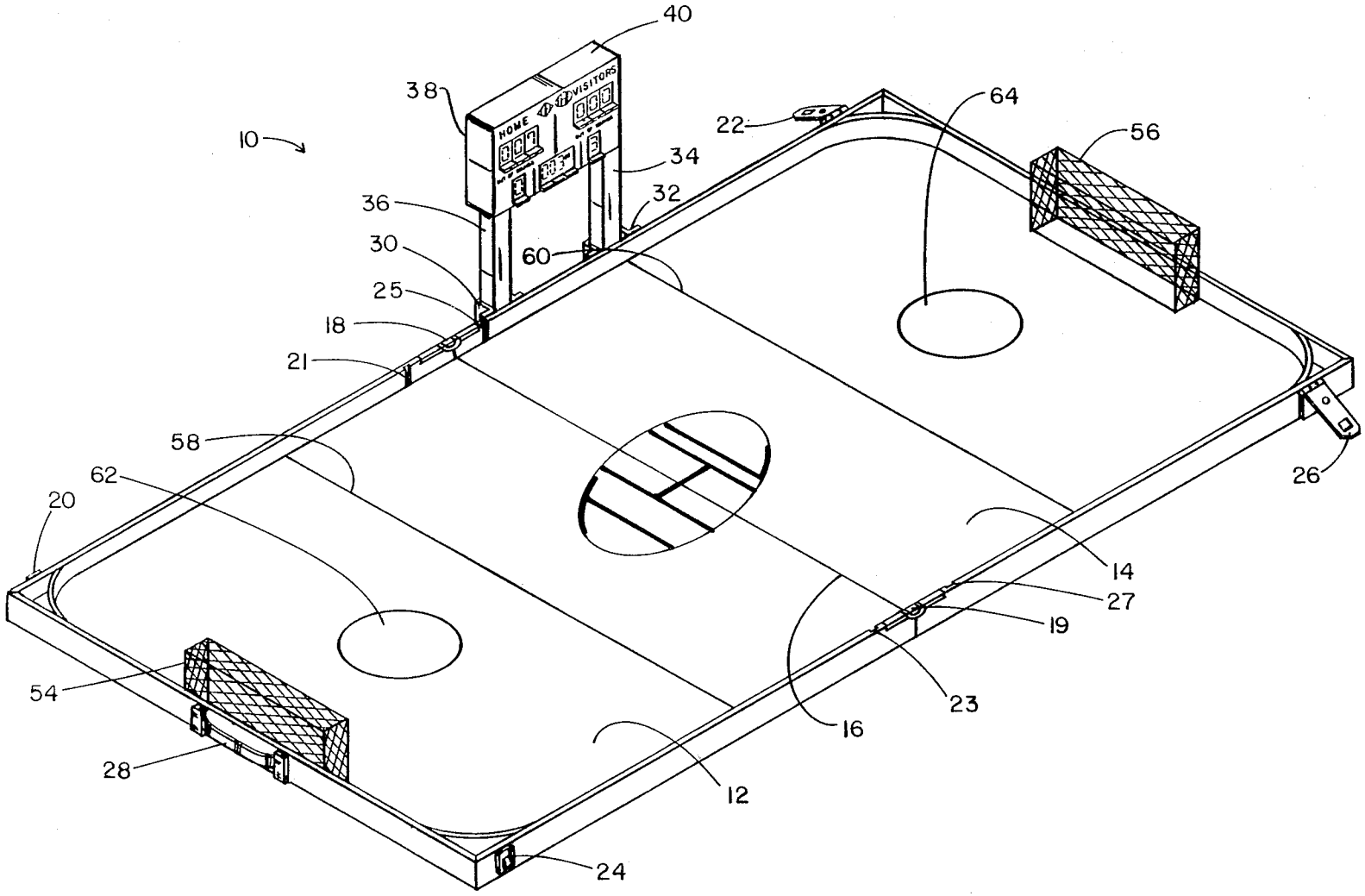
FIG. 2 is a perspective view which illustrates the back surface of the game board, in an open position, illustrating the hockey rink game area.

In FIG. 2, a perspective view illustrating the back surface of the game board is provided. The connection between the game board sections 12 and 14 is formed along a central line 16 by a pair of hinges 18 and 19, as previously described. The illustrated back surface of the game board forms a hockey rink game area, when in the illustrated open condition. The central line 16 in the hockey rink game area is designated as the center red line, and indicia representing the blue lines are provided at 58 and 60. A pair of face off circles 62 and 64 are designated adjacent goal nets 54 and 56 which are removably secured adjacent opposite ends of the board.

Figure 7:
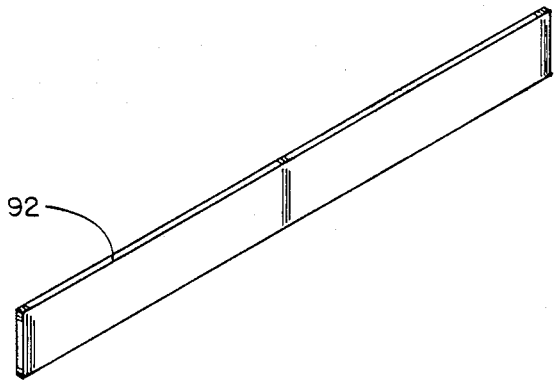
FIG. 7 is a perspective view illustrating a removable slat utilized in forming a retaining wall for the game board when folded to a closed position, for forming a storage case.

The nets 54 and 56 may be secured by any conventional means such as VELCRO, magnetically, or by a tacky adhesive. Additionally, small pins may be provided on the bottom surface of the nets 54 and 56 for insertion into sockets provided on the back surface of the game board. The scoreboard 38 is illustrated in a position inverted from that shown in FIG. 1. This allows the scoreboard to be utilized in either position, upon inversion of the board. The scoreboard 38 is of the electronic type which is provided with digital displays for time and scoring. The scoreboard 38 may be powered by an internal battery, or preferably by solar cell 40 provided on a top surface thereof. The solar cell 40 may be of the type conventionally utilized for powering electronic calculators. A first pair of notches 21 and 25 are formed in an interior portion on a first side wall of the game board. The notches 21 and 25 are disposed on opposite sides of the hinge 18. A second pair of aligned notches 23 and 27 are provided on an opposite interior side wall, on opposite sides of the hinge 19. These two pairs of aligned notches 21, 25, 23, 27 are dimensioned for insertion of two elongated removable rectangular slats 92 (FIG. 7) which are inserted and extend across the width of the board, parallel to line 16, when it is desired to fold the game board to a closed position for use as a storage case for the various playing pieces and accessories. The removable slats 92 (FIG. 7) are in abutting relation and disposed in a common plane when the game board is folded to a closed position. The abutting slats form an end wall for the resulting storage case.

Figure 3:
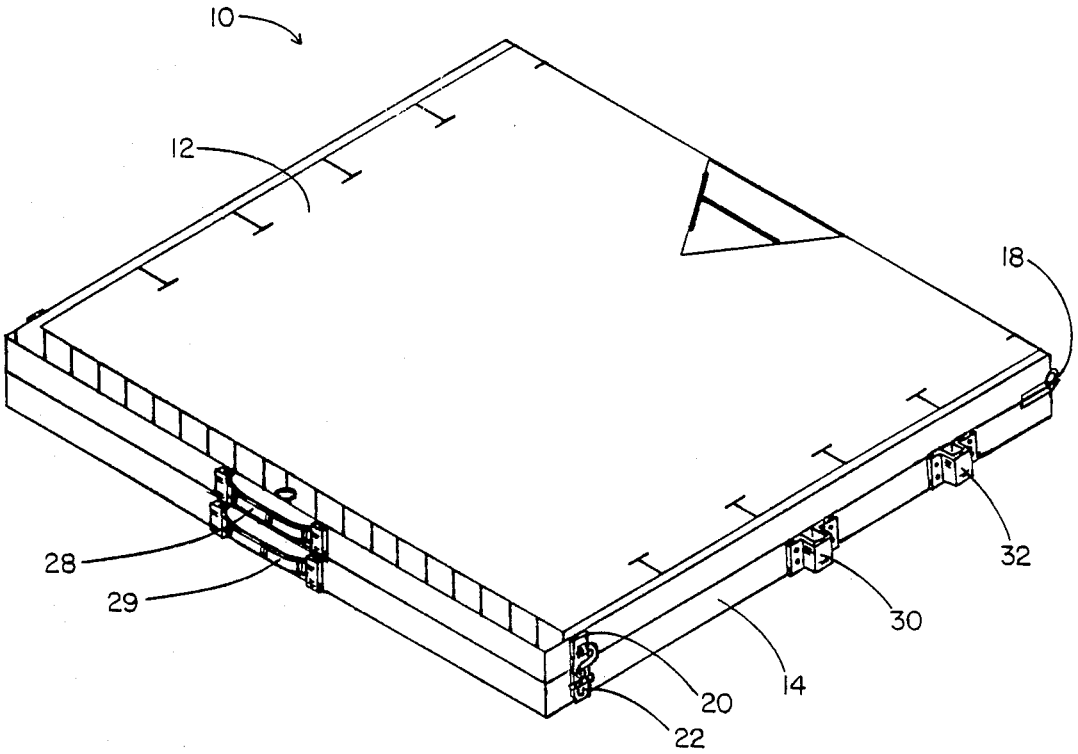
FIG. 3 is a perspective view which illustrates the game board folded to a closed position for use as a storage case.

FIG. 3 provides a perspective view illustrating the game board in a closed position.

Figure 5:
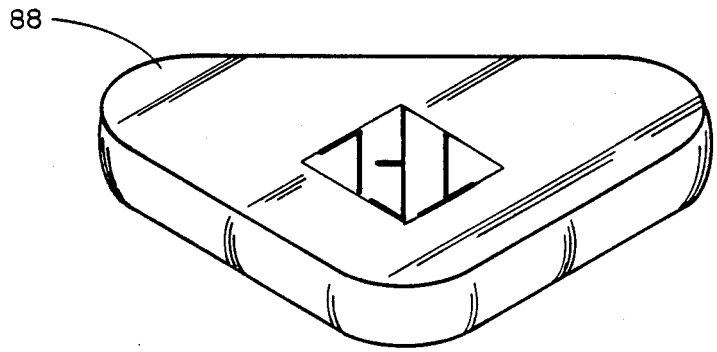
FIG. 5 is a perspective view illustrating a football game piece.

FIG. 5 provides a perspective view which illustrates a football playing piece utilized in the play of the table top football game.

Figure 4:
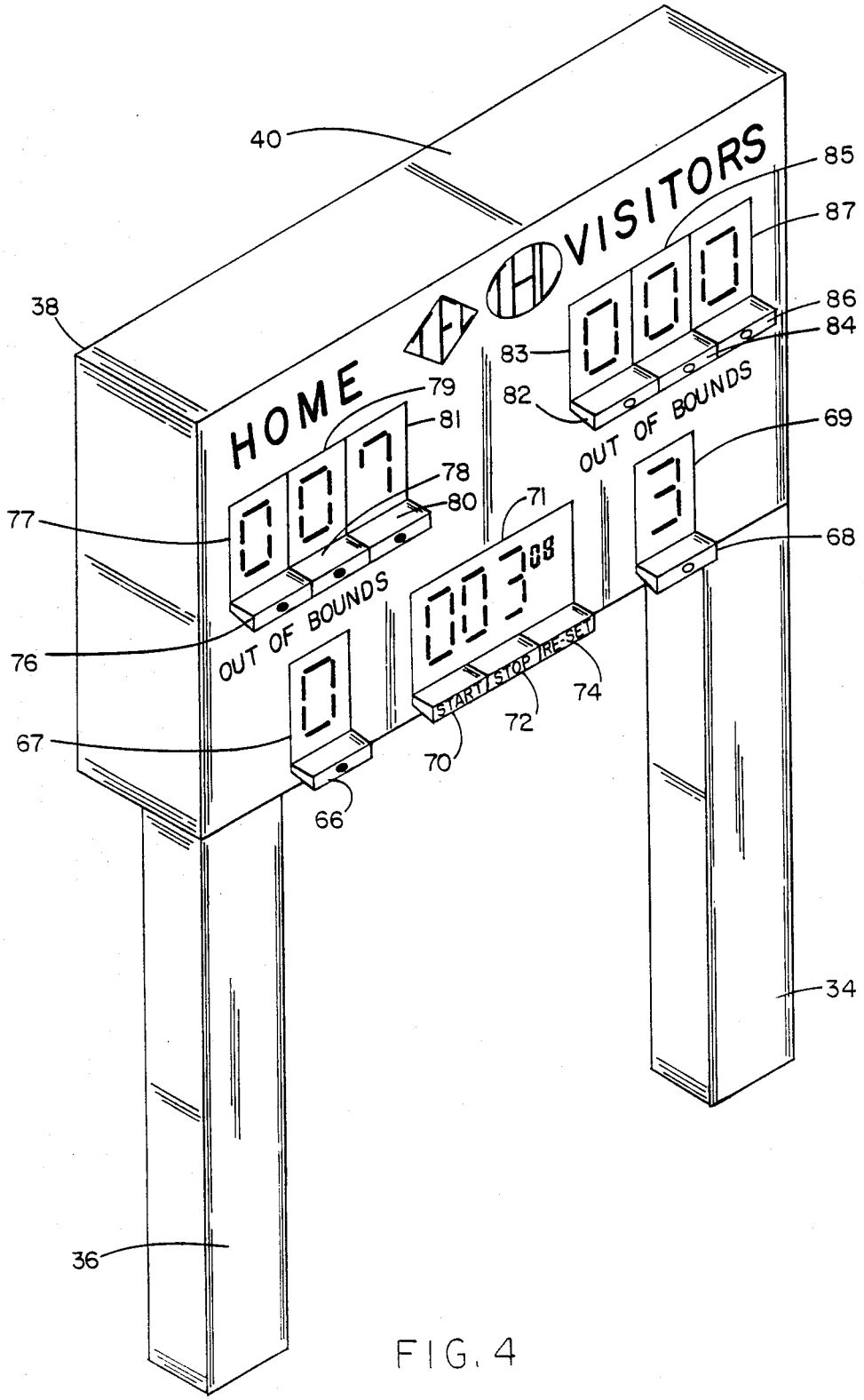
FIG. 4 is a perspective view which illustrates the details of the scoreboard of the game of the present invention.

With reference now to FIGS. 1 and 5, the play of the table top football game according to the present invention will now be described. A coin toss initially determines first possession between two competing players. For the kick off, the football is thrown unto the playing surface, attempting to score in a manner to be described subsequently. Play alternates between each of the two players on each play. In order to score a touch down, any part of the playing piece 88 must be in the player's selected end zone. If any portion of the football 88 extends over and out of the end zone, a touch down is still scored, as long as any portion of the ball remains in the end zone. Six points are manually incremented on the scoreboard 38 (FIG. 4) utilizing the buttons 76, 78, 80 or 82, 84 and 86 for the opposing player. The game time is kept by a clock 71 which may be manually activated utilizing buttons 70, 72 and 74. One player's score is displayed in a digital LCD type display 77, 79 and 81, and the opposing player's score is displayed in a digital LCD type display 83, 85 and 87. Digital display 67 and 69 activated by buttons 66 and 68 are provided for keeping track of remaining scoring functions such as out of bounds. Upon scoring a touch down, an extra point is made by manually flicking the ball through one of the goal posts 42 or 46. The ball playing piece 88 is flicked by utilizing the thumb and forefinger in an attempt to put the piece 88 through the uprights of the appropriate goal posts 42 or 46. The ball may be held on the upper surface of the game board utilizing the index finger of the opposite hand, or a slot may be provided in each one of the end zones for use as a kicking tee. If the ball leaves the playing surface, at any point, the other player kicks off. Any contact with the side lines 49 constitutes an out of bounds. Thee out of bounds earns a field goal attempt by the opposing player. Out of bounds are counted utilizing the push button 66 and 68 of the scoreboard 38 and displayed in digital LCD displays 67 and 69 (FIG. 4). A field goal attempt is made in the same fashion as the extra point after touch down. After each score, either a touch down or field goal, the out of bounds count is reset to zero, and the person who scores kicks off. If a field goal opportunity is missed, the opposing player kicks off. A safety is scored if the ball 88 is touched in any manner other than the normal course of play. For example, a player who inadvertently leaves his hand on the board could be a deliberate target. A safety is scored as two points, a field goal as three points, a touch down as six points and a point after touch down as one point. A time limit is set on the clock display 71 (FIG. 4) and four five minute quarters are played. Time between quarters is up to individual needs, however no more than one five minute period is allowed. In case of a tie, one five minute sudden death quarter is played. No ties will be allowed in play off games.

Figure 6:
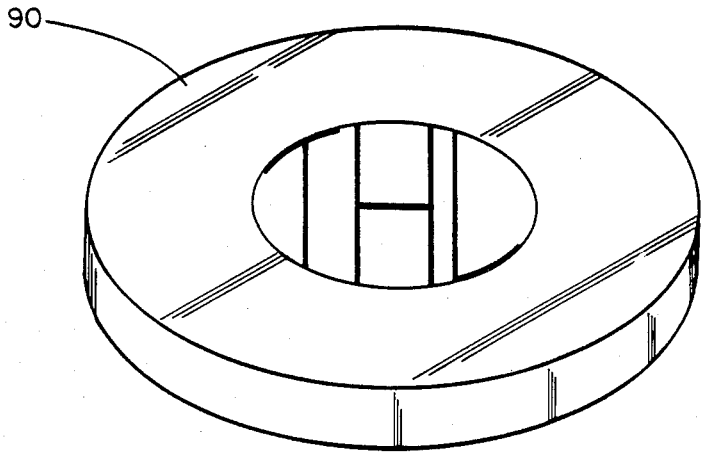
FIG. 6 is a perspective view illustrating a hockey game piece.

With reference now to FIG. 2 and 6, the manner of play of the table top hockey game of the present invention will now be described. Each of two opposing players has three circular disk shaped pieces or pucks 90, as shown in FIG. 6. A coin toss initially determines the start and possession. The defensive player first must drop the defensive playing pieces 90 into the face off circle 62 or 64, in front of the net to be defended 54 or 56. If a defensive game piece 90 enters the goal, a defensive penalty results. The men or man inside the net must be removed from the playing surface during the offensive drive. If the defensive men are stacked one on top of the other, the defense must be reset. After the defensive playing pieces or men 90 have been set, the offense sets the offensive playing pieces 90 by dropping them into the face off circle. If an offensive piece 90 enters into the goal zone, loss of possession occurs. the offensive men are stacked one on top of another, they must be reset by redropping them. If an offensive game piece 90 crosses the red line 16 during the set, off sides is called and loss of possession occurs. Offensive play may start by moving any of the three offensive pieces 90 in any direction. All following moves must move forward in between the remaining two pieces. If the offensive player cannot move between the two remaining pieces, loss of possession occurs. Upon loss of possession, the defensive men are deployed in the opposite face off circle, in the same manner as described above. However, the offense plays from where the pieces were left on the board. Again, the offense may move any of the three men in any direction in order to begin the attack. All consecutive moves must move forward in between the remaining pieces. In order to shoot on goal, two of the three offensive pieces must be set in the opponent's blue zone, behind the appropriate blue line 58 or 60. Any part of a game piece touching the blue line constitutes being set. Once a piece is set, it may not be touched by the offensive player again. The piece that is set can be played off of by the offensive player, as long as the piece set does not enter the goal zone. The piece must be completely inside the goal area in order to score, any portion of the piece touching the goal line constitutes a miss and a loss of possession occurs. Each score is tallied on the appropriate score display 77, 79, 81 or 83, 85, 87, illustrated in FIG. 4. If the offensive player cannot navigate between the remaining two players, loss of possession occurs. However, if this happens inside the offensive blue zone, all players are removed from the board. The offense then gets one penalty shot. One offensive piece is played in the offensive blue zone and may attempt a shot the length of the board. The offensive player may shoot from anywhere behind the blue line. Whether or not the goal is made, the player attempting the penalty shot retains possession. The offense and defense are then set as described above, and play according to the above described rules is resumed. The only time a player is allowed to remain inside of the goal area is when an offensive piece knocks a defensive piece into the area. This is the fault of the offense, and the offensive player must accept this condition and all difficulties derived therefrom. If the defensive player stops the offensive player from entering the goal area completely, change of possession occurs. Offense and defense as reset as described above. Play continues by offense until score, or loss of possession or end of period. Each period possession is determined by the flip of a coin. The scoreboard timer 71 (FIG. 4) is set for three, five minute periods. The highest scoring player wins. In the case of a tie, one five minute period will be played. No ties are allowed in play off game. In order to move the three game pieces, one of the game pieces is flicked by the index finger and thumb, between the remaining two pieces.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A combination table top football and hockey game, comprising:

a rectangular game board having opposite front and back surfaces, opposite parallel end walls connected by base parallel side walls;

said game board formed by two rectangular sections connected by a hinge along a central line for movement between open and closed positions;

indicia designating a football field game area on said front game board surface;

indicia designating a hockey rink game area on said back game board surface;

latch means for retaining said game board in said closed position;

a pair of spaced aligned scoreboard mounting brackets on a side wall of said rectangular board; and a scoreboard having aligned spaced legs removably received in said mounting brackets, said scoreboard being invertible for usage with said front or said back surface of said game board.

2. The combination table top football and hockey game of claim 1, wherein said indicia designating said football field game area include indicia representing yardage markers, side lines and end zones.

3. The combination table top football and hockey game of claim 2, further comprising a pair of sockets in opposite end zones of said front surface; and a pair of goal posts removably received in said sockets.

4. The combination table top football and hockey game of claim 3, further comprising a triangular football game piece.

5. The combination table top football and hockey game of claim 1, wherein said indicia designating said hockey rink game area include indicia representing face off circles, blue lines and a center red line.

6. The combination table top football and hockey game of claim 5, further comprising a pair of goal nets removably positioned adjacent opposite ends of said back surface.

7. The combination table top football and hockey game of claim 6, wherein said end and side walls of said rectangular board extended above said back surface, forming a raised perimeter around said hockey rink game area.

8. The combination table top football and hockey game of claim 7, further comprising a plurality of circular disk shaped hockey game pieces.

9. The combination table top football and hockey game of claim 1, wherein said scoreboard is provided with digital display electronic time and score counters powered by a solar cell.

10. A combination table top football and hockey game, comprising:

a rectangular game board having opposite front and back surfaces, opposite parallel end walls connected by base parallel side walls;

said game board formed by two rectangular sections connected by a hinge along a central line for movement between open and closed positions;

indicia designating a football field game area on said front game board surface;

indicia designating a hockey rink game area on said back game board surface;

latch means for retaining said game board in said closed position;

two pairs of spaced aligned notches formed in interior portions on opposite side walls, each pair of notches on each side wall being on opposite sides of said hinge; and a pair of elongated removable rectangualr slats dimensioned for removable frictional receipt in said notches, said slats disposed in a common plane movement of said game board to a closed position and forming a retaining wall.

11. The combination table top football and hockey game of claim 10, wherein said indicia designating said football field game area include indicia representing yardage markers, side lines and end zones.

12. The combination table top football and hockey game of claim 11, further comprising a pair of sockets in opposite end zones of said front surface; and a pair of goal posts removably received in said sockets.

13. The combination table top football and hockey game of claim 12, further comprising a triangular football game piece.

14. The combination table top football and hockey game of claim 10, wherein said indicia designating said hockey rink game area include indicia representing face off circles, blue lines and a center red line.

15. The combination table top football and hockey game of claim 14, further comprising a paid of goal nets removably positioned adjacent opposite ends of said back surface.

16. The combination table top football and hockey game of claim 15, wherein said end and side walls of said rectangular board extend above said back surface, forming a raised perimeter around said hockey rink game area.

17. The combination table top football and hockey game of claim 16, further comprising a plurality of circular disk shaped hockey game pieces.

18. A combination table top football and hockey game, comprising:

a rectangular board having opposite parallel end walls connected by spaced parallel side walls, said board formed by two rectangular sections connected along a central line by a hinge for movement between open and closed positions;

said board having front and back surfaces;

two pair of cooperating aligned latches on opposite side walls of said board for securing said board in a closed position;

said front surface forming a football field game area and bearing indicia representing yardage marker, side lines and end zones;

a triangular football game piece;

a pair of sockets in opposite end zones of said front surface;

a pair of goal posts removably received in said sockets;

a pair of spaced aligned scoreboard mounting brackets on a side wall of said rectangular board;

a scoreboard having aligned spaced legs removably received in said mounting brackets, said scoreboard being invertible for usage with said front or said back surface of said rectangular board;

said scoreboard having digital display electronic time and score counters, powered by a solar cell;

said back surface forming a hockey rink game area and bearing indicia representing face off circles, blue lines and a center red line;

a pair of goal nets removably positioned adjacent opposite ends of said back surface;

said end and side walls of said rectangular board extending above said back surface, forming a raised perimeter around said hockey rink game area;

a plurality of circular disk shaped hockey game pieces;

two pairs of spaced aligned notches formed in interior portions on opposite side walls, each pair of notches on each side wall being on opposite sides of said hinge; and a pair of elongated removable rectangular slats dimensioned for removable frictional receipt in said notches, said slats disposed in a common plane upon movement of said game board to a closed position and forming a retaining wall.

* * * * *